US009818528B2

(12) United States Patent
Chen et al.

(10) Patent No.: US 9,818,528 B2
(45) Date of Patent: Nov. 14, 2017

(54) TRANSFORMER CIRCUIT AND MANUFACTURING METHOD THEREOF

(71) Applicant: National Taiwan University, Taipei (TW)

(72) Inventors: Yi-Jan Chen, Taipei (TW); Hao-Shun Yang, Taipei (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 0 days.

(21) Appl. No.: 14/713,370

(22) Filed: May 15, 2015

(65) Prior Publication Data

US 2016/0111202 A1 Apr. 21, 2016

(30) Foreign Application Priority Data

Oct. 15, 2014 (TW) ..... 103135749 A

(51) Int. Cl.
*H01F 27/28* (2006.01)
*H01F 21/12* (2006.01)
*H01F 27/29* (2006.01)

(52) U.S. Cl.
CPC ..... *H01F 27/29* (2013.01); *H01F 27/2804* (2013.01); *H01F 2027/2809* (2013.01)

(58) Field of Classification Search
CPC ..... H01F 27/29
USPC ..... 336/170
See application file for complete search history.

(56) References Cited

U.S. PATENT DOCUMENTS 3,360,754 A * 12/1967 Gerdiman ..... H01F 27/2866 336/170
8,779,882 B2 * 7/2014 Phadke ..... H01F 27/2866 336/150
2008/0174396 A1 * 7/2008 Choi ..... H01F 27/2804 336/182

OTHER PUBLICATIONS

Hao-Shun Yang et al., "A 1.2-V 90-nm Fully Integrated Compact CMOS Linear Power Amplifier Using the Coupled L-Shape Concentric Vortical Transformer" IEEE Transactions on Microwave Theory and Techniques, Jul. 18, 2014, pp. 1-11.

* cited by examiner

*Primary Examiner* — Ronald Hinson
(74) *Attorney, Agent, or Firm* — Muncy, Geissler, Olds & Lowe, P.C.

(57) ABSTRACT

A transformer circuit and a manufacturing method thereof are proposed. The transformer circuit includes plural input modules and output modules. Each of the input modules includes a first primary coil and a second primary coil, and each of the primary coils has a first positive input terminal and a negative input terminal. The first primary coil and the second primary coil of each of the input modules are inductively coupled with each other. Each of the output modules includes a secondary coil. Each of the secondary coils includes a first terminal and a second terminal. The first terminal and the second terminal of each of the secondary coils are electrically connected to a first output port and a second output port, respectively. The first primary coil and the second primary coil of each of the input modules are inductively coupled to the secondary coil of the corresponding output module, respectively.

7 Claims, 6 Drawing Sheets

TRANSFORMER CIRCUIT AND MANUFACTURING METHOD THEREOF

CROSS-REFERENCES TO RELATED APPLICATIONS

This non-provisional application claims priority under 35 U.S.C. §119(a) on Patent Application No. 103135749 filed in Taiwan, R.O.C. on 2014 Oct. 15, the entire contents of which are hereby incorporated by reference.

BACKGROUND

Technical Field

The instant disclosure relates to a transformer circuit for applying to a radio-frequency power amplifier in a communication system, and more particular to a transformer circuit with wide frequency-bandwidth and low current-resistance drop.

Related Art

With the blooming developments of IT industries, the speed for data transmission is required to be faster, thus the long-term evolution (LTE) of 4G techniques becomes popular. However, because the number of the frequency-bands supported by the LTE technique are much more than those supported by the conventional 2G technique, the telecommunication device has to be improved to support multiple operating frequency bands.

Conventionally, a number of single frequency-band power amplifiers are utilized in the telecommunication device for supporting different operating frequency bands. For long, the conversion efficiency of the transformer circuit is deemed as the focus of the specification of the power amplifier. The main factor resulting in the efficiency reduction of power amplifier modules is the current-resistance drop (IR-drop) of the transformer circuit itself. Furthermore, along with the evolutions of the complementary metal oxide semiconductor (CMOS) manufacturing techniques, the size of the transistor is reduced continuously while the price of the chip per unit area is increased significantly. In addition, the power combiner of the power amplifier usually utilizes magnetically coupled passive components which do little effort on the size reduction in advanced CMOS manufacturing techniques (such as 90-nm manufacturing techniques) but have higher price; therefore, the area of the passive components or the transformer for power combining must be small for cost reduction.

SUMMARY

In view of this, an invention concept of the instant disclosure provides a transformer circuit comprising a plurality of input modules and a plurality of output modules. Each of the input modules comprises a first primary coil and a second primary coil, each of the primary coils has a first positive input terminal and a negative input terminal. The first primary coil and the second primary coil of each of the input modules are inductively coupled with each other. Each of the output modules comprises a secondary coil. Each of the secondary coils comprises a first terminal and a second terminal. The first terminal of each of the secondary coils is electrically connected to a first output port, and the second terminal of each of the secondary coils is electrically connected to a second output port. Each of the input modules corresponds to each of the output modules, respectively. The first primary coil and the second primary coil of each of the input modules are inductively coupled to the secondary coil of the corresponding output module, respectively.

An invention concept of the instant disclosure is a manufacturing method of a transformer circuit, the method comprising disposing a plurality of primary coils in pairs, so that the primary coils in pair are inductively coupled with each other; connecting a first terminal of each of a plurality of secondary coils to a first output port and connecting a second terminal of each of the secondary coils to a second output port; and inductively coupled all the paired primary coils with the secondary coils, respectively.

In conclusion, according to the transformer circuit and the manufacturing method thereof, the primary coils are inductively coupled with each other to increase the equivalent inductance at the primary side of the transformer circuit so as to accomplish wideband frequency characteristics, and the matching path passes through the low-Q matching path on the Smith chart. Furthermore, the transformer circuit uses different metal layers, and the layout of each of input modules is bar-shaped or L-profiled so as to improve the equivalent inductance at the primary side. In addition, the layouts of the output modules are substantially the same or very similar to each other and formed like spirals so as to improve the equivalent inductance at the secondary side. Therefore, the transformer circuit can provide high equivalent inductance which is required by a general transformer circuit, the layout area of the transformer circuit can be reduced, and the IR-drop impact of the transformer circuit can be improved. In addition, for a power amplifier module having the transformer circuit according to the instant disclosure, since the IR-drop impact of the transformer circuit is improved, the overall efficiency of the power amplifier module can be enhanced.

Detailed description of the characteristics and the advantages of the instant disclosure are shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
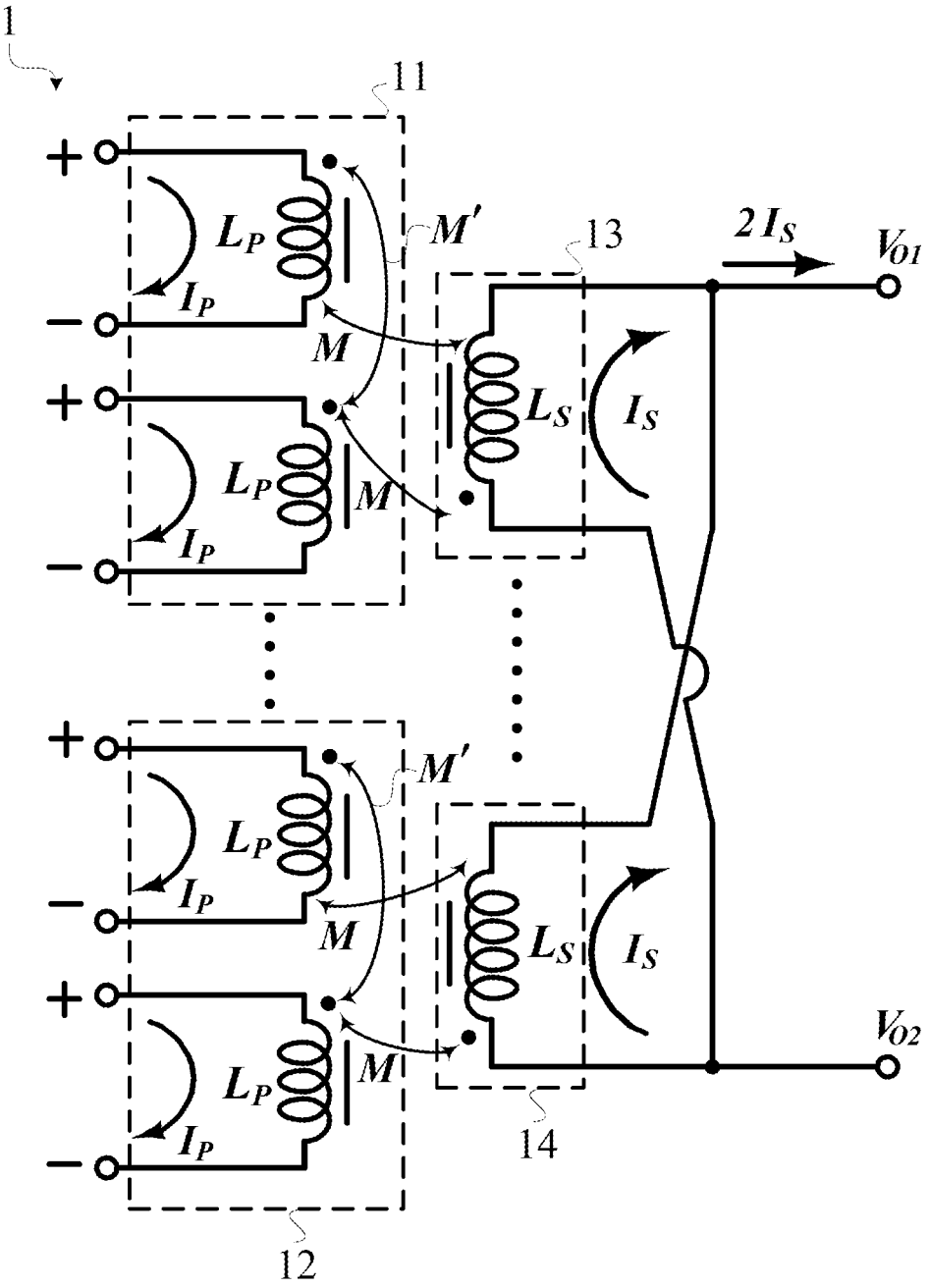
FIG. 1 is a schematic diagram of an exemplary embodiment of a transformer circuit according to the instant disclosure.

Please refer to FIG. 1, illustrating an exemplary embodiment of a transformer circuit 1 according to the instant disclosure. The transformer circuit 1 comprises a plurality of input modules and a plurality of output modules. Hereinafter, a transformer circuit 1 with two input modules 11, 12 and two output modules 13, 14 is provided for illustrative example, but embodiments are not limited thereto. The number of the input modules and the output modules can be determined based on practical requirements. Furthermore, in this embodiment, the input modules 11, 12 can be called the primary side of the transformer circuit 1, and the output modules 13, 14 can be called the secondary side of the transformer circuit 1.

Therefore, at the primary side of the transformer circuit 1, each of the input modules 11, 12 comprises two primary coils $L_P$. Each of the primary coils $L_P$ has a positive input terminal (denoted by + sign) and a negative input terminal (denoted by − sign), respectively. The primary coils $L_P$ are electrically connected to the corresponding front-end circuits (not shown) so as to receive the input signals from the front-end circuits and generate primary coil current $I_P$. Here, the front-end circuit can be power amplifier, but embodiments are not limited thereto.

Each of the primary coils $L_P$ comprises a center-tap terminal (not shown), and the center-tap terminal can be electrically connected to a power supply voltage. The center-tap terminal can be electrically connected to a constant-voltage power source provided as the voltage source. In some implementation aspects, the center-tap terminal can be electrically connected to other circuits provided as the voltage source.

In some implementation aspects, the two primary coils $L_P$ of each of the input modules 11, 12 are inductively coupled with each other attaining mutual inductance M' so as to increase the equivalent inductance, so that high inductance for wideband operation can be accomplished.

At the secondary side of the transformer circuit 1, each of the output modules 13, 14 comprises a secondary coil $L_S$. The first terminal of each of the secondary coils $L_S$ is electrically connected to a first output port $V_{O1}$, and the second terminal of each of the secondary coils $L_S$ is electrically connected to a second output port $V_{O2}$. Thus, the secondary coils $L_S$ of the output modules 13, 14 are connected in parallel at the secondary side.

In some implementation aspects, the second output port $V_{O2}$ is connected to ground or another circuit.

Moreover, the layout of the primary coils $L_P$ of each of the input modules 11, 12 are corresponding to the respective secondary coil $L_S$ of output modules 13, 14, so that each of the input modules 11, 12 corresponds to each of the output modules 13, 14, one by one, and the two primary coils $L_P$ of each of the input modules 11, 12 are inductively coupled to the secondary coil $L_S$ of the corresponding output module 13, 14, respectively. Accordingly, the secondary coil $L_S$ of each of the output modules 13, 14 generates secondary-coil inductive current $I_S$ with the same phase as the other secondary-coil inductive current $I_S$. Since the secondary coils $L_S$ of the output modules 13, 14 are connected with each other in parallel at the secondary side, the secondary-coil inductive currents $I_S$ are added with each other at the secondary side firstly, and then output to the first output port $V_{O1}$ or the second output port $V_{O2}$. Here, for a transformer circuit 1 comprising two output modules 13, 14, the current output from the first output port $V_{O1}$ or the second output port $V_{O2}$ is twice of the secondary-coil inductive current $I_S$ of the secondary coils $L_S$.

Figure 2:
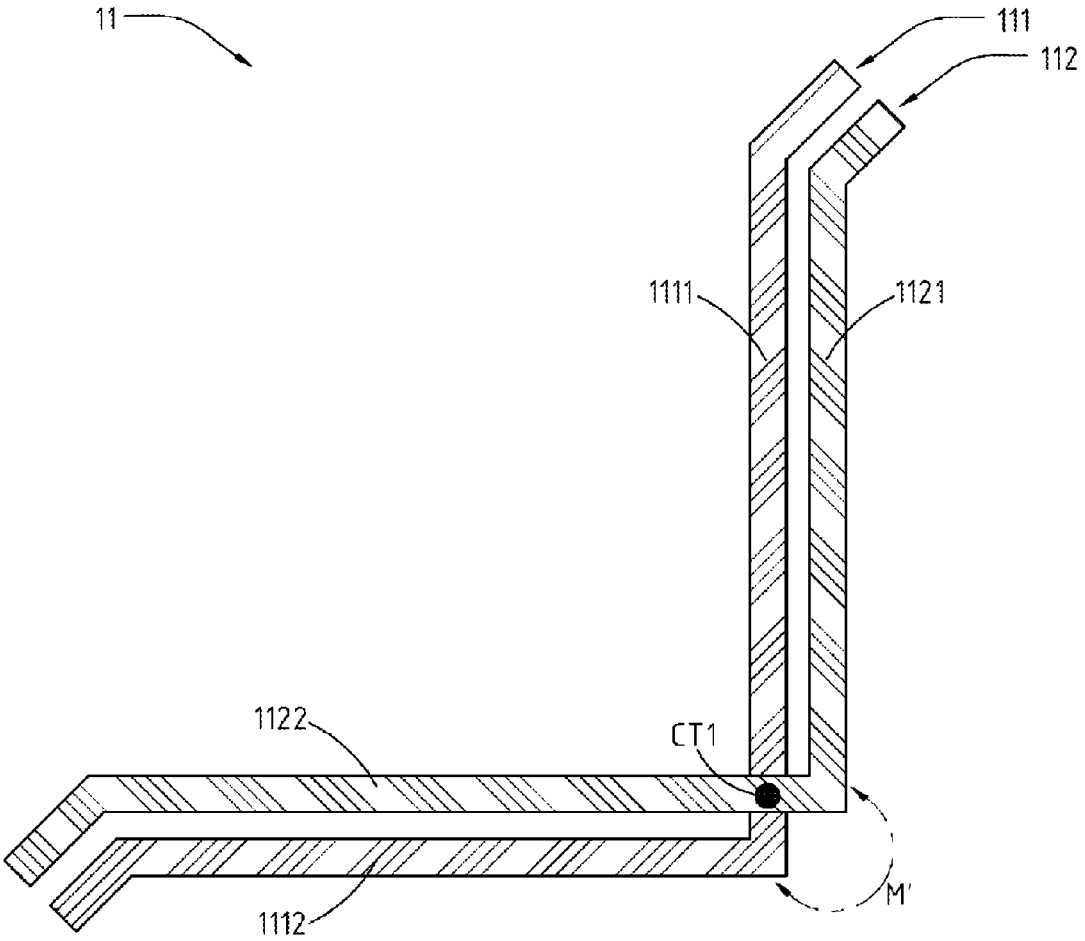
FIG. 2 is a diagram showing the layout of one of the input modules of the transformer circuit shown in FIG. 1 in L-profile coupled configuration.
Figure 3:
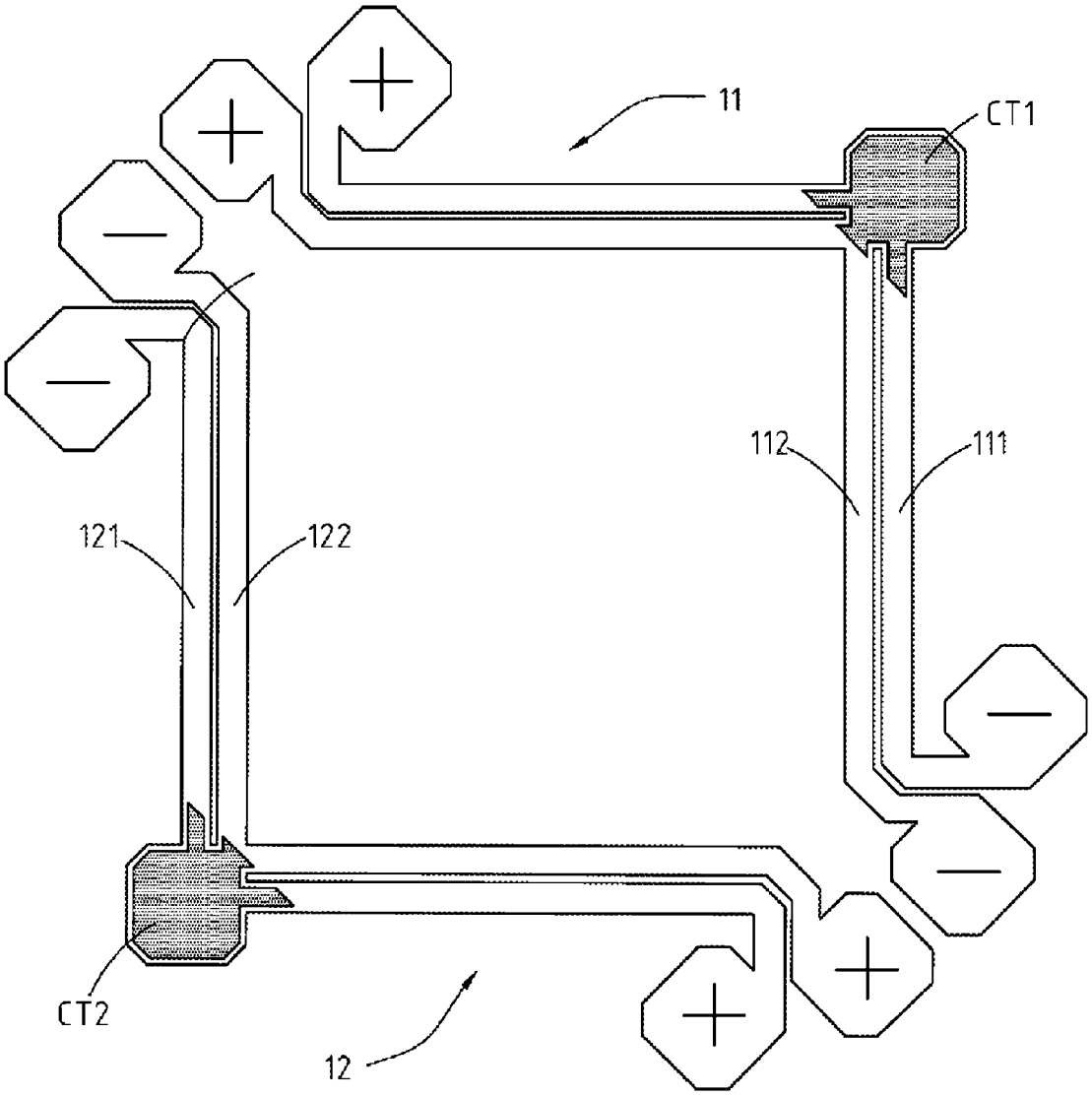
FIG. 3 is a diagram showing the layouts of the input modules of the transformer circuit shown in FIG. 1 in L-profile coupled configuration, respectively.

In an exemplary embodiment according to the instant disclosure, as mentioned, in order to perform the wideband characteristics, the two primary coils $L_P$ in each of the input modules 11, 12 are inductively coupled with each other attaining mutual inductance M' so as to increase the equivalent inductance, so that high inductance for wideband operation can be accomplished without the expense of the longer routing length and the larger occupied area for the input modules 11, 12. Furthermore, severe IR-drop impact issue is prone to occur for conventional layout of primary coils. Therefore, in the transformer circuit 1 according to the instant disclosure, the layout of each of the input modules 11, 12 at the primary side utilizes an L-profile coupled configuration, as shown in FIG. 2 and FIG. 3. Therefore, the two primary coils $L_P$ of each of the input modules 11, 12 are inductively coupled with each other to increase an extra equivalent inductance at the primary side, so that the length and the area of the layout for each of the input modules 11, 12 can be reduced significantly as compared to the rectangular ones without mutual coupling. In this matter, the performance degradation from IR-drop can be improved.

FIG. 2 illustrating a diagram showing the layout of one of the input modules 11, 12 of the transformer circuit 1 shown in FIG. 1 is in L-profiled coupled configuration. The input module 11 comprises two primary coils (hereinafter, called a first primary coil 111 and a second primary coil 112). In the layout of the input module 11, the first primary coil 111 comprises a first routing 1111 and a second routing 1112, and the second primary coil 112 comprises a first routing 1121 and a second routing 1122. The first primary coil 111 and the second primary coil 112 become the L-profiled coupled configuration.

The first routing 1111 of the first primary coil 111 is connected to the second routing 1112 of the first primary coil 111, and the first routing 1111 of the first primary coil 111 is perpendicular to the second routing 1112 of the first primary coil 111. Therefore, the layout of the first primary coil 111 is approximately formed as L-profiled. Similarly, the first routing 1121 of the second primary coil 112 is connected to the second routing 1122 of the second primary coil 112, and the first routing 1121 of the second primary coil 112 is perpendicular to the second routing 1122 of the second primary coil 112. Therefore, the layout of the second primary coil 112 is approximately formed as L-profiled.

Furthermore, the first routing 1111 of the first primary coil 111 is approximately adjacent to and parallel to the first routing 1121 of the second primary coil 112. Similarly, the second routing 1112 of the first primary coil 111 is approximately adjacent to and parallel to the second routing 1122 of the second primary coil 112. Moreover, the first routing 1111 of the first primary coil 111 and the second routing 1122 of the second primary coil 112 of the input module 11 are electrically connected to each other via connecting the portion where the first primary coil 111 and the second primary coil 112 overlap (as shown in FIG. 2) so as to construct the L-profile coupled configuration.

Here, the layout of the first primary coil 111 and the layout of the second primary coil 112 of the input module 11 are adjacent to each other closely so as to generate an additional mutual coupling inductance M' for increasing the equivalent inductance.

In some implementation aspects, the layout of the first primary coil 111 and the layout of the second primary coil 112 are located at the same metal layer, and the center-tap terminal CT1 is the intersection (or called an intersecting portion) for the first primary coil 111 and the second primary coil 112. The center-tap terminal CT1 can be electrically connected to the power supply.

Please refer to FIG. 3, illustrating a diagram showing the layouts of the input modules 11, 12 of the transformer circuit 1 shown in FIG. 1 which are in L-profile coupled, respectively. The technical features of the layout configuration of the input module 12 are approximately similar to that of the input module 11, and are not discussed below.

Therefore, in the case of attaining the same equivalent inductance, L-profiled layout configuration takes shorter length and smaller area than the conventional layout configuration, so that the cost for the circuit implementation can be reduced.

Figure 4:
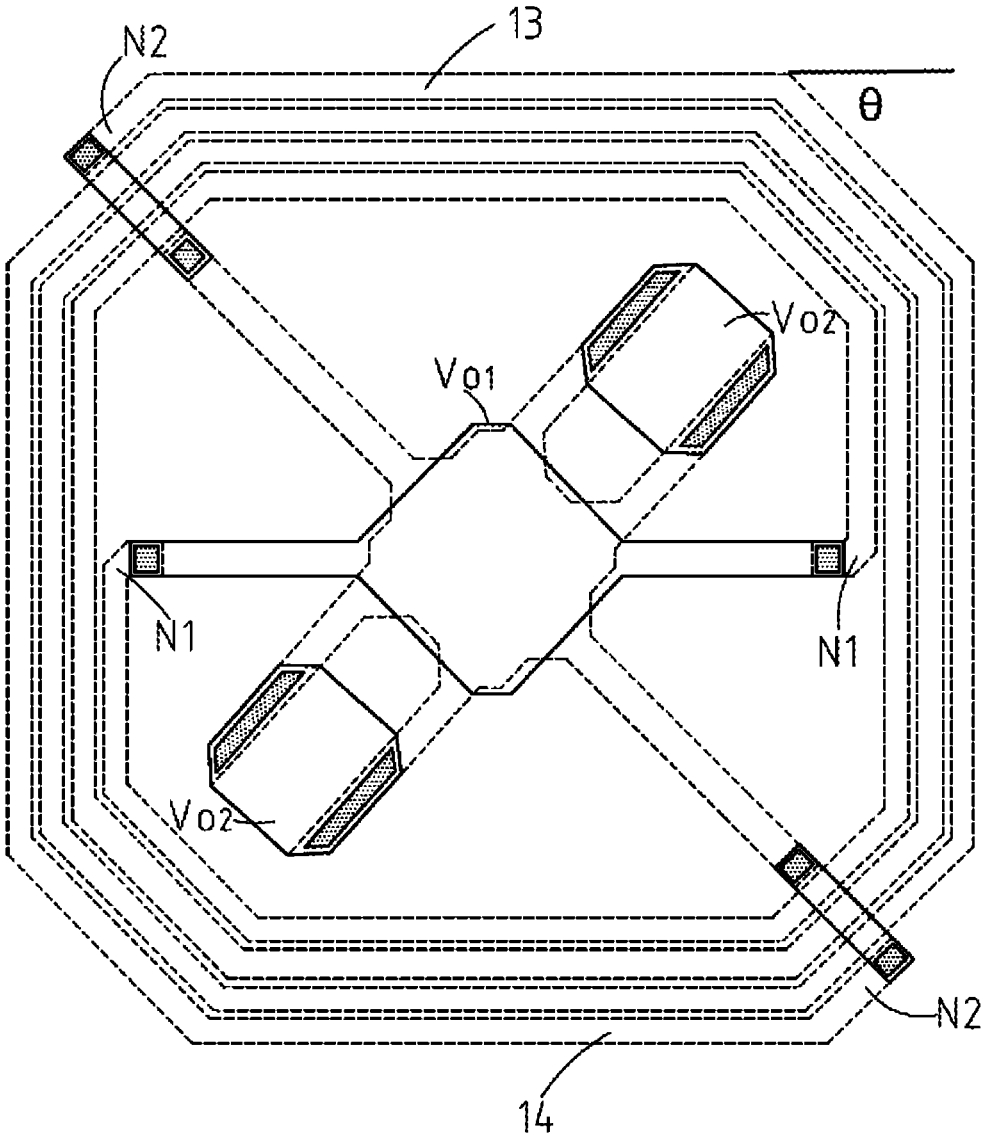
FIG. 4 is a diagram showing the layout of the output modules of the transformer circuit shown in FIG. 1.

Please refer to FIG. 4, illustrating a diagram showing the layout of the output modules 13, 14 of the transformer circuit 1 shown in FIG. 1. The secondary coils $L_S$ of the output modules 13, 14 are located at the same metal layer. The secondary coil $L_S$ of each of the output modules 13, 14 comprises two connecting sections (the section from the center of the coil to the first terminal N1) and a winding section (from the first terminal N1 to the second terminal N2) between the two connecting sections. Each of the winding sections is routed spirally, and the adjacent winding sections of the secondary coils $L_S$ of the output modules 13, 14 are spaced apart from each other. Here, the secondary coils $L_S$ of the output modules 13, 14 are formed as a spiral structure. The appearance of the layout of the secondary coils $L_S$ is vortical, and the winding sections of the secondary coils $L_S$ interlace to each other closely so as to increase the equivalent inductance.

In some implementation aspects, the secondary coil $L_S$ of each of the output modules 13, 14 is located at a first metal layer (illustrated in dot lines). The winding sections of the secondary coils $L_S$ of the output modules 13, 14 are symmetric and are winded clockwise or counterclockwise respect to the symmetrical point, respectively. Therefore, the first terminals N1 are configured opposite with each other and respectively connected to a second metal layer (illustrated in solid lines) through vias (illustrated in trapezoids with dots inside), so that the first terminals N1 are electrically connected to the first output port $V_{O1}$, but embodiments are not thus limited thereto. In some implementation aspects, the first terminals N1 are directly electrically connected with each other, but are not connected at the second metal layer through the vias.

As shown in FIG. 4, the secondary coils $L_S$ are at the first metal layer. In the layout of the secondary coil $L_S$ of the output module 13, the second terminal N2 is firstly going through a first via (the via corresponding to the secondary coil $L_S$ of the output module 13 and distant from the center of the secondary coil $L_S$ of the output module 13) to the second metal layer. And then, at the second metal layer, the second terminal N2 goes through toward the center of the layout until the second terminal N2 reaches a second via (the via adjunct to the secondary coil $L_S$ of the output module 13 and adjacent to the center of the secondary coil $L_S$ of the output module 13). Thereafter, the second terminal N2 is passing through the second via to be connected to the first metal layer again. In other words, the layout path of the second terminal N2 of the secondary coil $L_S$ of the output module 13 at the second metal layer is laterally over-crossing or under-crossing the winding sections of the secondary coils $L_S$ of the output modules 13, 14 at the first metal layer. Similarly, the layout path of the second terminal N2 of the secondary coil $L_S$ of the output module 14 at the second metal layer is laterally over-crossing or under-crossing the winding sections of the secondary coils $L_S$ of the output modules 13, 14 at the first metal layer. Accordingly, the second terminals N2 of the secondary coils $L_S$ are electrically connected to the second output port $V_{O2}$, but embodiments are not limited thereto. In some implementation aspects, the second terminals N2 are directly electrically connected to the second output port $V_{O2}$, respectively.

In some implementation aspects, the second output port $V_{O2}$ is electrically connected to ground.

Furthermore, the winding section of the secondary coil $L_S$ of each of the output modules 13, 14 is winded by an angle θ of 45 degrees or smaller than 45 degrees with respect to the original extension direction thereof, to reduce the transmitting reflectance during the signal transmission. In other words, an angle θ between the original extension direction and the winded extension direction of the winding section of the secondary coil $L_S$ of each of the output modules 13, 14 is 45 degrees or smaller than 45 degrees.

Figure 5:
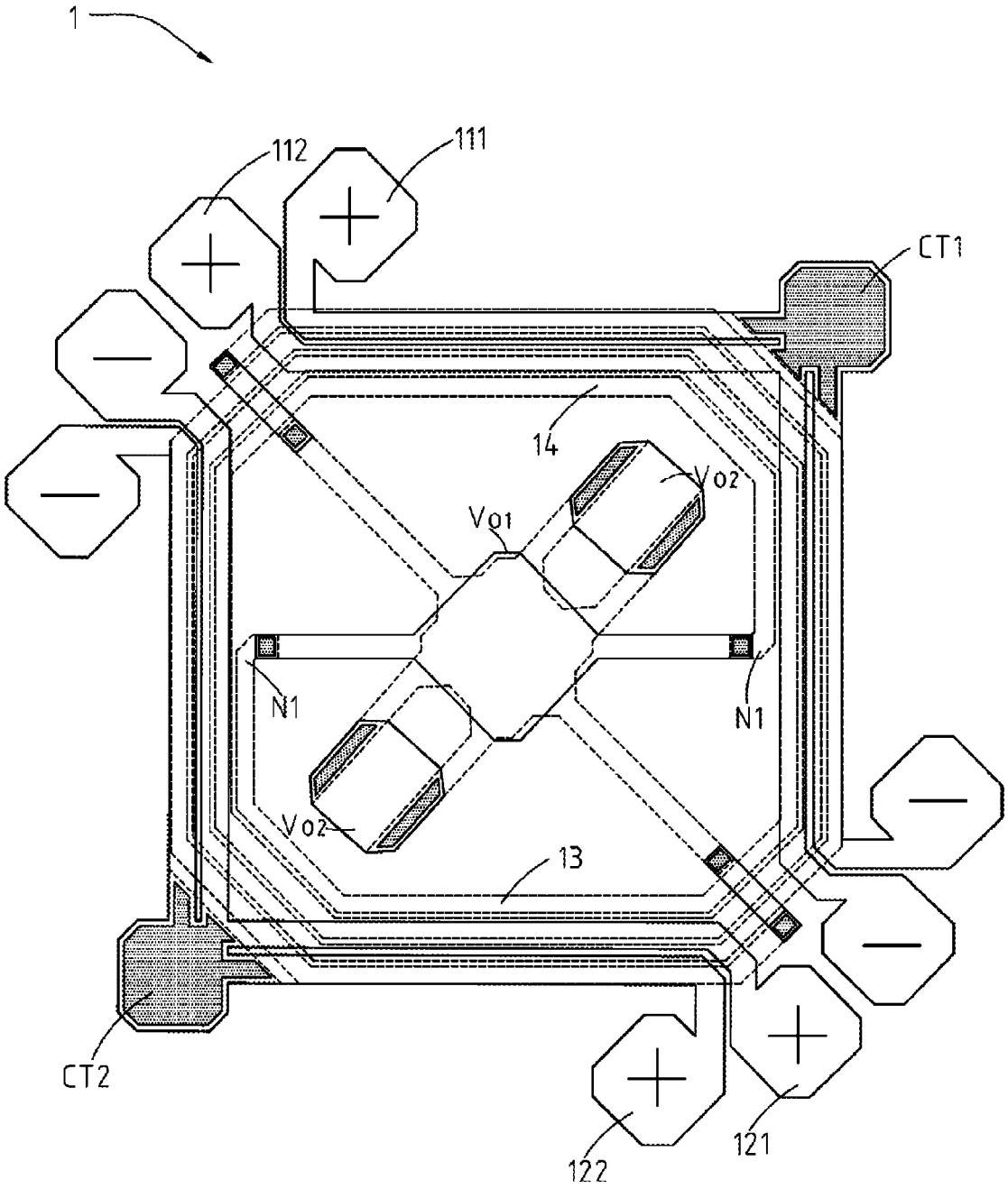
FIG. 5 is a diagram showing the layout of an exemplary embodiment of the transformer circuit according to the instant disclosure.

Please refer to FIG. 5, illustrating a diagram showing the layout of an exemplary embodiment of the transformer circuit 1. The transformer circuit 1 according to the instant disclosure uses two metal layers (the first metal layer and the second metal layer) for the layout. In this embodiment, the layout of the output modules 13, 14 is located at the first layer (represented by dot lines), and the layout of the input modules 11, 12 is located at the second layer (represented by solid lines). The layout of each of the input modules 11, 12 corresponds to the layout of each of the output modules 13, 14, and the layouts of the input modules 11, 12 are distributed symmetrically on the second metal layer.

Here, the second metal layer where the input modules 11, 12 are located at is stacked on the first metal layer where the output modules 13, 14 are located at, but embodiments are not limited thereto. That is, in some implementation aspects, the first metal layer where the output modules 13, 14 are located at is stacked on the second metal layer where the input modules 11, 12 are located at.

As shown in FIG. 5, the layout of the transformer circuit 1 is formed by stacking the layout of the input modules 11, 12 (as provided in FIG. 3) on the layout of the output modules 13, 14 (as provided in FIG. 4), and the details about the overall layout of the transformer circuit 1 according to the instant disclosure are already described and not discussed below.

Figure 6:
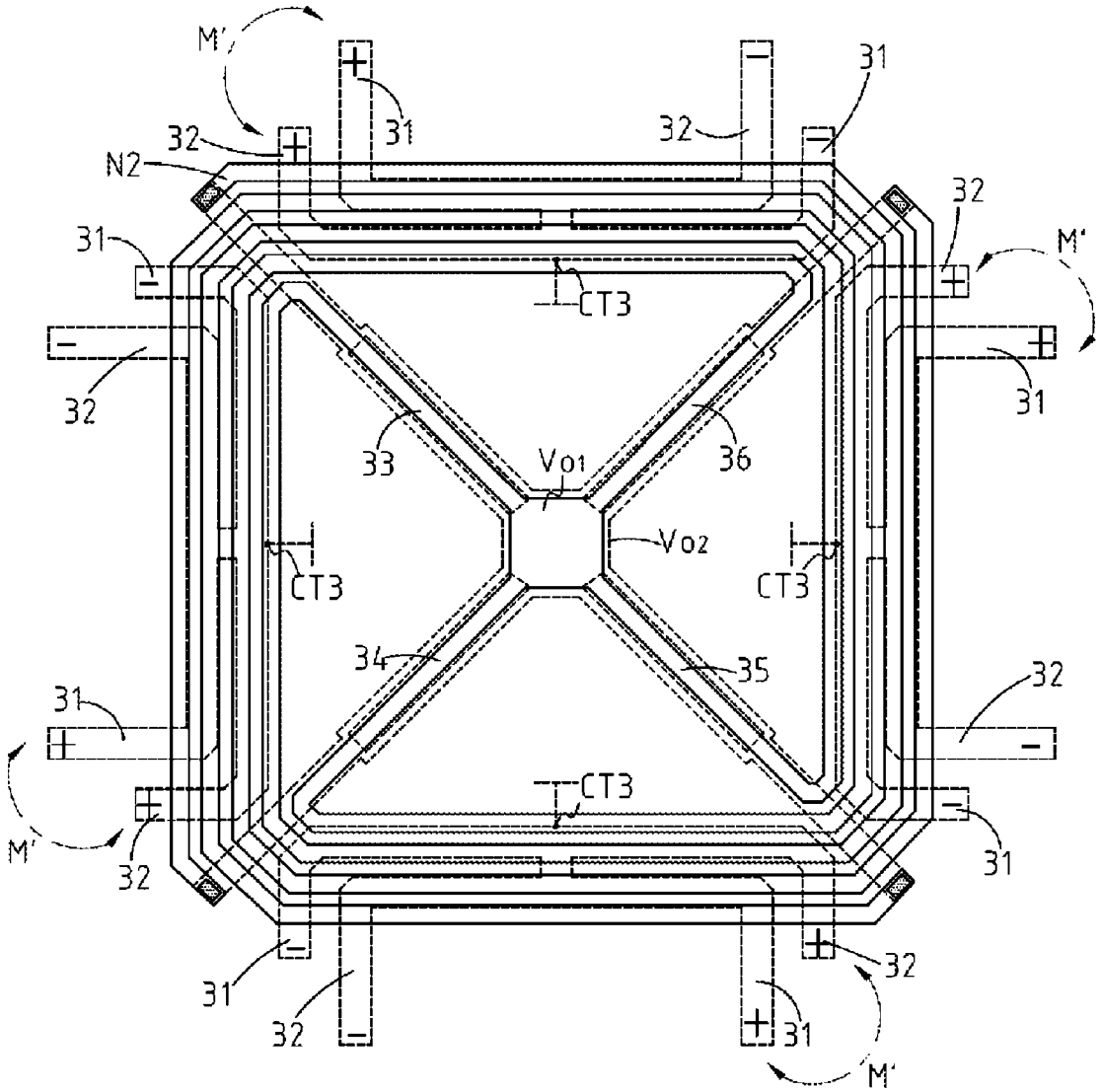
FIG. 6 is a diagram showing the layout of another exemplary embodiment of the transformer circuit according to the instant disclosure.

Please refer to FIG. 6, illustrating a diagram showing the layout of another exemplary embodiment of a transformer circuit 1 according to the instant disclosure. In this embodiment, the transformer circuit 1 according to the instant disclosure uses two metal layers (hereinafter, the first metal layer and the second metal layer). Hereinafter, a transformer circuit having four input modules located at the second metal layer (represented by dot lines) and four output modules located at the first metal layer (represented by solid lines) is taken as an illustrative example.

In the layout, the first terminals of the secondary coils 33, 34, 35, 36 of the output modules are extended to a center point and connected with each other, so that the first terminals of the output modules are electrically connected to the first output port $V_{O1}$. Furthermore, the winding sections of the secondary coils 33, 34, 35, 36 of the output modules are symmetrical and are winded clockwise or counterclockwise respect to the center point (that is, the symmetry point), respectively. In this embodiment, the winding sections of the secondary coils 33, 34, 35, 36 of the output modules are winded closely to each other so as to increase the equivalent inductance. In this embodiment, the layouts of the secondary coils 33, 34, 35, 36 of the output modules are substantially the same or similar to each other, so that the process variations among the secondary coils 33, 34, 35, 36 of the output modules can be similar.

As shown in FIG. 6, the secondary coils 33, 34, 35, 36 are at the first metal layer. In the layout of the secondary coil 33, the second terminal N2 is going through a first via (the via adjunct to the secondary coil 33 and distant from the center of the secondary coil 33) to the second metal layer. And then, at the second metal layer, the second terminal N2 goes through toward the center of the layout. In other words, the layout path of the second terminal N2 of the secondary coils 33 at the second metal layer is laterally over-crossing or under-crossing the winding sections of the secondary coils 33, 34, 35, 36 at the first metal layer. Similarly, the layout path of the second terminal N2 of each of the secondary coils 34, 35, 36 at the second metal layer is laterally over-crossing or under-crossing the winding sections of the secondary coils 33, 34, 35, 36. Accordingly, the second terminals N2 of the secondary coils 33, 34, 35, 36 are electrically connected to the second output port $V_{O2}$, but embodiments are not limited thereto. In some implementation aspects, the second terminals N2 are directly electrically connected to the second output port $V_{O2}$, respectively, while in some implementation aspects, the second terminals N2 are electrically connected to ground.

Furthermore, the winding section of the secondary coil 33, 34, 35, 36 of each of the output modules is winded by an angle of 45 degrees or smaller than 45 degrees with respect to the original extension direction of the winding section, to reduce the transmitting reflectance during the signal transmission. In other words, an angle between the original extension direction and the winded extension direction of the winding section of the secondary coil 33, 34, 35, 36 of each of the output modules is 45 degree or smaller than 45 degrees.

In this embodiment, the layouts of the two primary coils 31, 32 of each of the input modules are formed as slabs (bar-type shaped), and each of the adjacent primary coils 31, 32 are inductively coupled with each other to increase the equivalent inductance. Here, the input modules are configured to be annular (the two L-profiled layout in FIG. 5 and the four bar-type layout in FIG. 6 of the primary coils form an annular structure). The layout of the input modules and the layout of the output modules are distributed symmetrically.

Further, the layouts of the two primary coils 31, 32 of each of the input modules are adjacent to and parallel to each other. The two primary coils 31, 32 of each of the input modules are electrically connected with each other at an intersection, namely the center-tap point, and the intersection can be further electrically connected to the power supply voltage. Here, the intersection is the center-tap terminal CT3 of the two primary coils 31, 32.

The layout of the primary coils 31, 32 of each of the input modules corresponds to the layout of the secondary coil 33, 34, 35, 36 of each of the output modules. That is, the layouts of the input modules are stacked on or below the layouts of the output modules, so that the input modules allow the received signals to be inductively coupled to the secondary coils 33, 34, 35, 36 of the output modules.

Based on the above, according to the transformer circuit and the manufacturing method thereof, the primary coils are inductively coupled with each other to increase the equivalent inductance at the primary side of the transformer circuit so as to accomplish wideband frequency characteristics, and the matching path passes through the low low-Q matching path on the Smith chart. Furthermore, the transformer circuit uses two metal layers, and the layout of each of input modules is bar-shaped or L-profiled so as to improve the equivalent inductance at the primary side. In addition, the layouts of the output modules are substantially the same or very similar to each other and formed like spirals so as to improve the equivalent inductance at the secondary side. Therefore, the transformer circuit according to the instant disclosure can provide high equivalent inductance which is required by a general transformer circuit, the layout area of the transformer circuit can be reduced, and the IR-drop of the transformer circuit can be reduced. In addition, for a power amplifier module having the transformer circuit according to the instant disclosure, since the IR-drop of the transformer circuit is reduced, the overall efficiency of the power amplifier module can be enhanced.

While the instant disclosure has been described by the way of example and in terms of the preferred embodiments, it is to be understood that the invention needs not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A transformer circuit, comprising:

a plurality of input modules, each of the input modules comprising a first primary coil and a second primary coil, each of the primary coils having a positive input terminal and a negative input terminal, the first primary coil and the second primary coil of each of the input modules inductively coupled with each other; and a plurality of output modules, each of the output modules comprising a secondary coil, each of the secondary coils comprising a first terminal and a second terminal, the first terminal of each of the secondary coils electrically connected to a first output port, and the second terminal of each of the secondary coils electrically connected to a second output port, each of the input modules corresponding to each of the output modules, respectively, the first primary coil and the second primary coil of each of the input modules are inductively coupled to the secondary coil of the corresponding output module, respectively, wherein a layout of the output modules and a layout of the input modules are located at different metal layers, wherein the secondary coil of each of the output modules comprises two connecting sections and a winding section connected between the two connecting sections, each of the winding sections is winded spirally, and the adjacent winding sections are spaced apart from each other, and wherein the secondary coils of the output modules are symmetrical about the center point of the layout of the output modules, and the winding sections are interlaced to each other.

2. The transformer circuit according to claim 1, wherein the first primary coil and the second primary coil of each of the input modules respectively comprises a center-tap terminal.

3. The transformer circuit according to claim 1, wherein each of the primary coils of each of the input modules comprises:

a first routing and a second routing, the first routing is connected to the second routing, and the first routing is perpendicular to the second routing.

4. The transformer circuit according to claim 3, wherein the first routings of each of the input modules are parallel to each other, the second routings of each of the input modules are parallel to each other, the first routing of the first primary coil and the second routing of the second primary coil of each of the input modules are electrically connected to each other, and the first routing of the first primary coil and the second routing of the second primary coil intersects with each other in each input module.

5. The transformer circuit according to claim 3, wherein the layout of each of the input modules corresponds to the layout of each of the output modules, the layout of each of the input modules is distributed with respect to the layout of each of the output modules, respectively.

6. The transformer circuit according to claim 1, wherein the primary coils of each of the input modules is bar-type shaped, the layout of the first primary coil and the layout of the second primary coil of each of the input modules are adjacent to each other, so that the first primary coil and the second primary coil of each of the input modules are inductively coupled with each other.

7. The transformer circuit according to claim 6, wherein the layout of the input modules and the layout of the output modules are stacked with each other, and the input modules are configured to be annular, so that the input modules are inductively coupled to the respective output modules.

* * * * *